United States Patent [19]

Bell et al.

[11] 4,292,895

[45] Oct. 6, 1981

[54] EXPLOSIVE SAFE-ARMING APPARATUS FOR PERFORATING GUNS

[75] Inventors: William T. Bell; Jose B. Garcia, both of Houston, Tex.

[73] Assignee: Schlumberger Technology Corporation, Houston, Tex.

[21] Appl. No.: 82,686

[22] Filed: Oct. 9, 1979

[51] Int. Cl.[3] ..... F42C 15/34

[52] U.S. Cl. ..... 102/306; 102/254; 102/260; 102/318; 166/55.1; 175/4.6

[58] Field of Search ..... 175/4.6, 4.56; 166/55.1; 102/20, 21.6, 254, 260, 222; 89/1 C

[56] References Cited

U.S. PATENT DOCUMENTS

| | | | |
|---|---|---|---|
| 2,655,993 | 10/1953 | Spencer | 89/1 C X |
| 3,719,144 | 3/1973 | Tlam | 102/28 R |
| 3,739,724 | 6/1973 | Tlam | 102/28 R |
| 3,878,786 | 4/1975 | Ridgeway | 102/27 R |
| 4,011,815 | 3/1977 | Garcia | 102/20 |
| 4,172,421 | 10/1979 | Regalbuto | 166/55.1 X |

*Primary Examiner*—David H. Brown

[57] ABSTRACT

An explosive safe-arming apparatus for use with a perforating gun which includes a fixed barrier disposed between a detonator explosive and a booster explosive, and a movable barrier disposed between laterally facing portions of the detonator and booster explosives. Upon actuating the movable barrier, either a predetermined perforator disarming operating position or perforator arming operating position are obtained.

14 Claims, 3 Drawing Figures

EXPLOSIVE SAFE-ARMING APPARATUS FOR PERFORATING GUNS

BACKGROUND OF THE INVENTION

1. Field of the Invention

The invention relates to a explosive safe-arming apparatus for use in a perforating gun for oil and gas well wireline operations.

2. Description of the Prior Art

The perforating guns most commonly used in present-day wireline service operations are typically comprised of an elongated fluid-tight body or so-called "enclosed carrier" which houses one or more shaped explosive charges and the necessary accessories for selectively detonating these charges from the surface. One typical style of such carriers employs an expendable, thin-walled steel tube which has reusable upper and lower heads fluidly sealed in each end of the tubing. Other common types of enclosed carriers have heavy, explosion-resistant walls so that the carrier can be retrieved. This latter type of carrier is ordinarily provided with a removable head or an access port to accommodate the installation of the shaped charges and their associated detonating components.

Those skilled in the art will recognize, of course, that a typical shaped charged perforating gun ordinarily poses no serious hazards so long as there is either a spatial interruption in the explosive detonating train for the gun or the electrical wiring to the detonating train is suitably disconnected. Thus, the usual practice is to substantially complete the assembly of a given gun, but in some approved manner, leave the gun in a relatively safe or "disarmed" condition until just before it is to be operated. Another such safe-handling technique is simply not to install the electrically-initiated detonator for a given gun until it is being prepared for immediate operation.

It will be appreciated, however, that such typical safe-handling techniques are not entirely satisfactory. For example, where a perforating gun is disarmed by temporarily removing part of its explosive detonating train, there are still safety and logistic problems involved in handling the removed explosive. Moreover, where last minute electrical connections or other detailed preparations are required to ready the perforator for firing, these final steps often must be made under severe environmental conditions which can easily contribute to either a malfunction or even an unsafe or improper operation. Accordingly, it is most desirable to not have any electrical connections made in the field, but rather at the factory or in a field office.

One approach to solve the foregoing described problems may be found in U.S. Pat. No. 4,011,815, issued on Mar. 15, 1977, to Jose B. Garcia. This patent discloses a safe-handling arming apparatus wherein a receptor detonating explosive is fixedly disposed within an enclosed carrier, and a donor detonating explosive is movably disposed in a spaced relationship from the receptor detonating explosive, whereby the two explosives may be brought within relative detonating proximity of one another. In another embodiment of the safe-handling arming apparatus disclosed in the Garcia patent, the receptor detonating and donor detonating explosives are in an end-to-end parallel relationship, and a movable barrier member is disposed between the two explosives.

By removing the barrier, the two explosives are in detonating proximity of one another.

The safe-handling arming apparatus of the Garcia patent suffers from some of the disadvantages previously described with respect to other devices, in that in order to arm the detonating train, it is necessary for the operator to contact the donor explosive to move it into engagement with the receptor explosive. With regard to the other embodiment of the Garcia patent, wherein the donor and receptor explosives are in an end-to-end parallel relationship with a barrier member removably disposed therebetween, an operator does not have to handle the donor explosive to arm the gun. However, in that embodiment an additional component for the perforating gun is required to support the explosives in position, as well as, the use of a shock-attenuating material to make that additional component. Furthermore, the section apparatus was not readily adaptable for use in all sizes of perforating guns, and the perforating gun components required modification to accept that safe-handling apparatus.

Accordingly, prior to the development of the present invention, there has been no safe-arming apparatus for use with perforating guns which is: readily adaptable for use with existing perforating guns, without modification thereto; does not require last minute electrical connections to be made in the field to ready the perforator for firing; provides additional operator safety, insofar as the operator does not have to handle the donor detonator explosive material; is inexpensive to manufacture; and efficient and easy to use. Therefore, the art has solved an efficient, safe and inexpensive safe-arming device for perforating guns, which can be used with conventional perforating guns without modification thereto.

SUMMARY OF THE INVENTION

In accordance with the invention, the foregoing benefits have been achieved through the present safe-arming apparatus. The safe-arming apparatus for perforating guns of the present invention includes an improvement in a well bore perforator having an enclosed carrier with an access port therein and explosive means in the carrier, wherein the carrier includes: at least one shaped explosive charge; a receptor detonating explosive cooperatively arranged and adapted for detonating said shaped explosive charge; and a donor detonating explosive adapted for detonating the receptor explosive. The improvement comprises an explosive safe-arming apparatus which includes: means for retaining the donor detonating explosive; means for retaining the receptor detonating explosive laterally disposed from the donor detonating explosive; a fixed barrier disposed between the donor detonating and receptor detonating explosive; a movable barrier disposed between laterally facing portions of the donor detonating and the receptor detonating explosives; and a movable barrier actuating means for selectively translating the movable barrier either into engagement with the fixed barrier, whereby the donor detonating and receptor detonating explosives are separated by the fixed and movable barriers and are in a predetermined perforator disarming operating position, or into a spaced relationship from the fixed barrier whereby the laterally facing portions of the donor detonating and receptor detonating explosives are in a predetermined perforator-arming operating position.

A feature of the present invention includes a portion of the movable barrier actuating means being disposed within the access port and the movable barrier actuating means is an elongate member affixed to the movable barrier. A further feature of the present invention resides in the fact that the ends of the fixed barrier and the movable barrier are formed to provide a lap joint when the fixed barrier and the movable barrier are engaged into the predetermined perforator disarming operating position.

An additional feature of the present invention is that the safe-arming apparatus includes means for securing the movable barrier in both the predetermined perforator arming and disarming operating positions, and the provision of a guide means for the movable barrier to provide alignment of the movable barrier with respect to the fixed barrier. Additionally, the means for securing the movable barrier comprises a recessed portion in or the end surface of the movable barrier for operative engagement with a flexible detent member disposed on the guide means.

The explosive safe-arming apparatus of the present invention is for use with a well bore perforator having a receptor detonating explosive and a donor detonating explosive adapted for detonating said receptor explosive, and comprises: a fixed barrier adapted to be disposed between the donor detonating and receptor detonating explosives; a movable barrier adapted to be disposed between laterally facing portions of said donor detonating and receptor detonating explosives; and a movable barrier actuating means for selectively translating the movable barrier either into engagement with the fixed barrier, whereby the donor detonating and receptor detonating explosives are separated by the fixed and movable barriers and are in a predetermined perforator disarming operating position, or into a spaced relationship from the fixed barrier whereby the laterally facing portions of the donor detonating and receptor detonating explosives are in a predetermined perforator-arming operating position.

The explosive safe-arming apparatus of the present invention, when compared with previously proposed prior art safe-handling apparatus has the advantages of safety, ease of use and assembly, inexpensive to manufacture and assemble, and readily adaptable for use with existing well bore perforators, without modification thereof.

While the invention will be described in connection with the preferred embodiment, it will be understood that it is not intended to limit the invention to that embodiment. On the contrary, it is intended to cover all alternatives, modifications, and equivalents as may be included with the spirit and scope of the invention as defined by the appended claims.

DETAILED DESCRIPTION OF THE INVENTION

Figure 1:
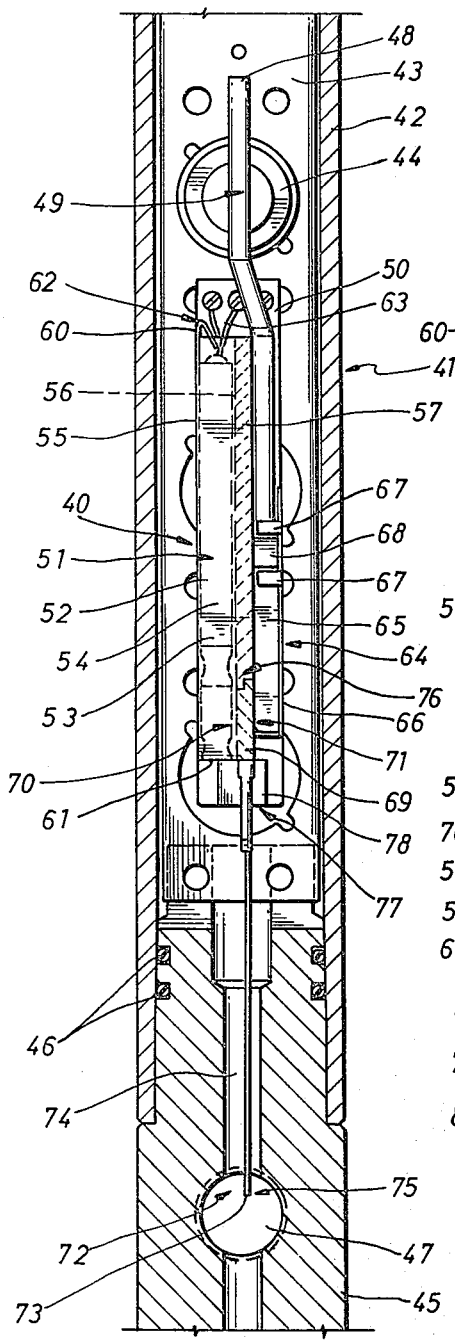
FIG. 1 is a cross-sectional view of a well bore perforator provided with the explosive safe-arming apparatus of the present invention.

In FIG. 1, an enlarged cross sectional view is shown of the new and improved safe-arming apparatus 40 of the present invention in use with a conventional well bore perforator, or perforating gun 41. As illustrated perforator 41 includes a tubular housing, or enclosed carrier, 42 formed of a length of steel tubing and having its upper end fluidly sealed by a reusable head (not shown) suitably arranged to dependently support an elongated metal carrier strip 43 having enlarged openings arranged at spaced intervals therealong for receiving a corresponding number of typical shaped explosive charges one of which is shown at 44. Each shaped charge is mounted on the carrier strip 43 and preferably faces toward a reduced-thickness wall portion (not shown) of housing 42. The lower end of the carrier housing 42 is closed by a reusable head 45 that is fluidly sealed within the carrier, as by O-rings 46. Head 45 is shown to include an access port 47, the purpose of which will be hereinafter described. Alternatively, the housing 42 of perforating gun 41 could have an access port 47 disposed therein.

To controllably detonate the shaped charges 44, the perforator 41 has a charge-detonating train which includes a length of detonating cord 48 extending along the carrier strip 43, which is successively positioned in detonating proximity of each shaped charge 44 as at 49. Detonating cord 48 is operatively coupled to the new and improved safe-arming apparatus 40 of the present invention as will be hereinafter described.

Figure 2:
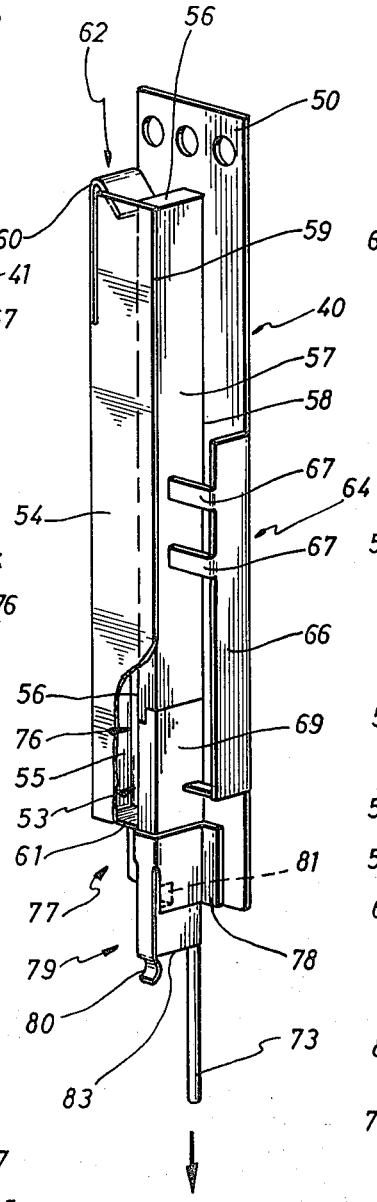
FIG. 2 is a perspective view of the explosive safe-arming apparatus of the present invention, wherein the apparatus is illustrated to be in the predetermined perforator disarming operating position.

In the preferred embodiment of the new and improved safe-arming apparatus 40 of the present invention, as seen in FIGS. 1 and 2, a base member 50 is mounted upon carrier strip 43. Mounted on base member 50 is a means 51 for retaining a conventional donor detonating explosive, or electrically-actuated detonator, 52. Donor detonating explosive retention means 51 is seen to include a detonation chamber 53 formed by base member 50, top wall 54, side wall 55 and the inner face 56 of a fixed barrier member 57, all of which are mounted upon base member 50 in any suitable fashion, such as by welding or by being formed integrally with base member 50. Preferably top wall 54 and side wall 55 are formed integral with base member 50 and are suitably bent from the blank stock material of base member 50 to form the top and side walls 54 and 55 of chamber 53. Barrier member 57 is preferably welded to base member 50 along line 58 and to top wall 54 along line 59.

Side wall 55 may also be formed with a flexible closure member 60 at one end thereof and a fixed closure wall 61 at the other end of side wall 55. By pressing flexible closure member 60 outwardly from detonation chamber 53, the detonator 52 may be inserted within chamber 53. Flexible closure member 60 is formed as by bending as at 62, whereby a small space is provided for conventional wiring 63 to enter chamber 53 and be affixed to detonator 52.

Still referring to FIGS. 1 and 2, it is seen that safe-arming apparatus 40 further includes means for retaining 64 receptor detonating explosive, or booster, 65 in a position laterally disposed from the detonator 52. Booster retention means 64 may preferably include an L-shaped wall 66 with two clip members 67 depending therefrom. Clip members 67 and L-shaped wall member 66 is preferably formed integrally with base member 50 and is bent from the piece of stock material which forms base member 50.

As seen in FIG. 1, as is customary, the lower end of detonating cord 48 is securely crimped in a socket in the booster 65. To facilitate the assembly of the perforating gun 41, the lowermost portion of detonating cord 48 and the uppermost portion of booster 65 are retained against base member 50 of the safe-arming apparatus by booster retaining clips 67. An enlarged sealing sleeve, or elastomeric grommet, 68 is preferably disposed around the junction of the detonating cord 48 and the booster 65 between booster retaining clips 67. The grommet 68 is appropriately sized to closely fit the available space between retaining clips 67 so that the booster 65 and detonating cord 48 will be fixedly retained in their illustrated position preventing axial displacement thereof.

Referring now once again to FIGS. 1 and 2, it is seen that a fixed barrier member 57 is disposed between the detonator 52 and booster 65, as previously described. Additionally, the safe-arming apparatus 40 of the present invention includes a movable barrier member 69 which is disposed between laterally facing portions of the detonator 52 and booster 65 as at 70 and 71. Attached to movable barrier 69 is an actuating means 72 for selectively translating the movable barrier 69 either into, or out of, engagement with the fixed barrier 57, as to be hereinafter described in more detail. Preferably, movable barrier actuating means 72 is comprised of an elongate member 73, which preferably is a metallic rod. Rod 73 extends through an axial passage 74 which is disposed in head 45, whereby rod 73 has a portion thereof, as at 75, disposed within, and visible through, access port 47 in head 45, whereby an operator may grasp movable barrier actuating means 73 to selectively translate movable barrier 69 into, or out of, engagement with fixed barrier member 57.

By means of painting, or otherwise suitably marking, different parts of the end 75 of rod 73, such as with different colored stripes, an operator can view end 75 through access port 47 to determine if movable barrier 69 is in, or out of, engagement with fixed barrier 57. For example, if a green stripe is visible through access port 47, an operator would know that movable barrier 69 is in engagement with fixed barrier 57. If actuating means 72 is pulled downwardly and the portion of rod 73 visible through access port 47 has a red stripe thereon, an operator would know that movable barrier 69 is not in engagement with fixed barrier 57.

Still referring to FIGS. 1 and 2, it is seen that the end portions of fixed barrier 57 and movable barrier 69, which are moved into engagement with one another, are formed to provide a lap joint 76 upon movement of the movable barrier 69 into an abutting relationship with fixed barrier member 57, in order to provide satisfactory seal between the fixed barrier 57 and movable barrier 69. It is also seen that the safe-arming apparatus 40 of the present invention is provided with guide means 77 for movable barrier 69 to provide alignment of the movable barrier 69 with respect to the fixed barrier 57, upon movement of movable barrier 69. Guide means 77 may preferably include a somewhat U-shaped bracket 78 which is affixed to base member 50, and in which movable barrier 69 is disposed in a sliding relationship therewith. Bracket 77 also includes means 79 for securing movable barrier 69 in a predetermined open position from fixed barrier 57, which preferably is a flexible detent member 80 which cooperates with a recessed portion, or notch, 81 formed in movable barrier 69, as clearly shown in FIG. 3.

Figure 3:
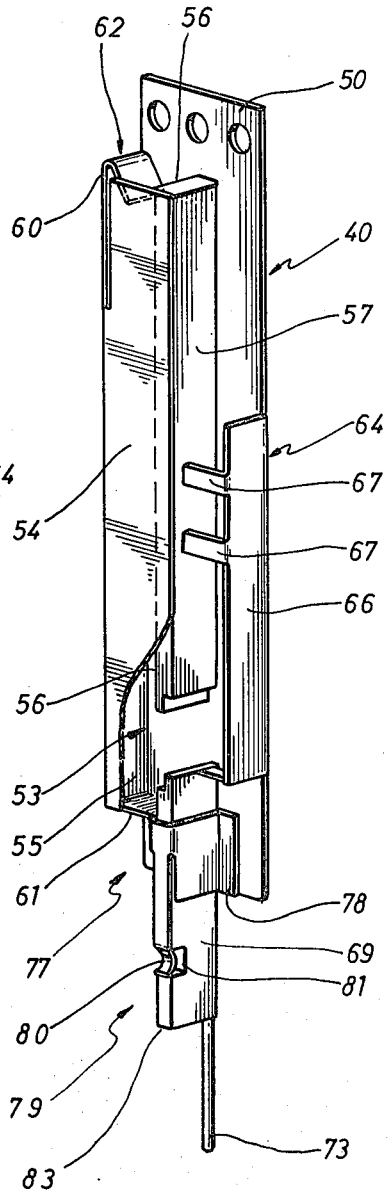
FIG. 3 is a perspective view of the explosive safe-arming apparatus of the present invention, wherein it is illustrated to be in the predetermined perforator-arming operating position.

Referring now to FIGS. 2 and 3, the operation of the safe-arming apparatus 40 of the present invention will be described in greater detail. In FIG. 2, it is seen that, when movable barrier 69 is in abutting relationship with fixed barrier 57 at lap joint 76, explosive safe-arming apparatus 40 is in a predetermined perforator disarming operating position. When safe-arming apparatus 40 is in this position, any accidental explosion of donor detonating explosive 52 will be isolated from the receptor detonating explosive 65 and contained in donor detonating explosive chamber 53, whereby such accidental initiation of detonator 52 will assuredly be ineffectual for detonating the booster 65. For given sizes of detonators 52 and boosters 65, the thickness of movable barrier 69 and fixed barrier 57 will be sized accordingly, whereby the direct transmission of significant detonation forces from detonator 52 to booster 65 will be blocked or effectively prevented. Accordingly, when the safe-arming apparatus of the present invention 40 is in the predetermined perforator disarming operating position, it can be reasonably assured that detonation of the detonator 52 will be incapable of setting off the booster 65. It must, of course, be recognized that the presence of the fixed barrier 57 and movable barrier 69 between detonator 52 and booster 65 is effective for causing the donor detonating explosive 52 to be out of detonating proximity of the receptor detonating explosive 65. Lap joint 76 insures a sealing engagement between fixed barrier member 57 and movable barrier member 69, when they are in the predetermined perforator disarming operating position, to insure that significant detonation forces from the detonator 52 in detonator chamber 53 will not be transmitted to the booster explosive 65. Of course, it should be readily realized by one of ordinary skill in the art that other joint configurations between fixed barrier 57 and movable barrier 69 could be provided, such as the formation on the ends of the fixed barrier 57 and movable barrier 69 to provide a tongue and groove joint upon engagement of the fixed barrier 57 and movable barrier 69 into the predetermined perforator disarming operating position.

Turning now to FIG. 3, it is seen that the safe-arming apparatus 40 of the present invention is in a predetermined perforator arming operating position, wherein movable barrier 69 has been translated into a spaced relationship from the fixed barrier 57 whereby the laterally facing portions 70 and 71 of the donor detonating explosive 52 and the receptor detonating explosive 65 are exposed to one another in a predetermined perforator arming operating position. Upon detonation of detonator 52 in detonation chamber 53 detonation forces will be transmitted through the space 82 between fixed barrier 57 and movable barrier 69 to booster 65 which will then be detonated, and which will in turn detonate detonating cord 48. In the predetermined perforator arming operating position for safe-arming apparatus 40 shown in FIG. 3, it is seen that flexible detent member 80 on the movable barrier guide means 77 cooperates with notch 81 in movable barrier 69 to secure the movable barrier 69 in the predetermined perforator arming operating position.

With reference to FIG. 2, it should be noted that when the safe-arming apparatus 40 of the present invention is in the predetermined perforator disarming operating position, flexible detent member 80 is in engagement with the bottom end surface 83 of movable barrier 69 whereby movable barrier 69 is secured in the predetermined perforator disarming operating postion.

The foregoing description of the invention has been directed in primary part to a particular preferred embodiment in accordance with the requirements of the Patent Statutes and for purposes of explanation and illustration. It will be apparent, however, to those skilled in this art that many modifications and changes in this specific apparatus may be made without departing from the scope and spirit of the invention. For example, other structures could be utilized for retaining the booster and detonator explosives in a fixedly, spaced lateral location, whereby upon translation of the movable barrier member into the predetermined perforator arming operating position, laterally facing portions of the detonator and booster will be exposed to one another.

It is applicants' intention in the following claims to cover such modifications and variations as fall within the true spirit and scope of the invention.

What is claimed is:

1. In a well bore perforator having an enclosed carrier with an access port therein and explosive means in said carrier, including at least one shaped explosive charge, a receptor detonating explosive cooperatively arranged and adapted for detonating said shaped explosive charge, and a donor detonating explosive adapted for detonating said receptor explosive, the improvement which comprises:

an explosive safe-arming apparatus which includes:

means for retaining said donor detonating explosive;

means for retaining said receptor detonating explosive laterally disposed from said donor detonating explosive;

a fixed barrier disposed between the donor detonating and receptor detonating explosives;

a movable barrier disposed between laterally facing portions of said donor detonating and receptor detonating explosives; and a movable barrier actuating means for selectively translating the movable barrier either into engagement with the fixed barrier, whereby the donor detonating and receptor detonating explosives are separated by the fixed and movable barriers and are in a predetermined perforator disarming operating position, or into a spaced relationship from the fixed barrier whereby the laterally facing portions of said donor detonating and receptor detonating explosives are in a predetermined perforator-arming operating position.

2. The improvement of claim 1 wherein said movable barrier actuating means has a portion thereof disposed within the access port, and is an elongate member affixed to said movable barrier.

3. The improvement of claim 1 wherein the ends of the fixed barrier and the movable barrier are formed to provide a lap joint when the fixed barrier and the movable barrier are engaged into the predetermined perforator disarming operating position.

4. The improvement of claim 3 wherein the movable barrier actuating means has a portion thereof disposed within the access port and is an elongate member affixed to said movable barrier; the ends of the fixed barrier and the movable barrier are slidably engaged with one another by movement of said elongate member; and the ends of the fixed barrier and the movable barrier are formed to provide a lap joint upon being slidably engaged.

5. The improvement of claim 1 which further includes means for securing the movable barrier in the predetermined perforator arming operating position.

6. The improvement of claim 5 which further includes guide means for said movable barrier to provide alignment of the movable barrier with respect to the fixed barrier; and the means for securing the movable barrier comprises a recessed portion in the movable barrier for operative engagement with a flexible detent member disposed on said guide means.

7. The improvement of claim 1 which further includes means for securing the movable barrier in the predetermined perforator disarming operating position.

8. The improvement of claim 7 which further includes guide means for said movable barrier to provide alignment of the movable barrier with respect to the fixed barrier; and the means for securing the movable barrier comprises a flexible detent member disposed on said guide means which is in operative engagement with an end surface of the movable barrier.

9. An explosive safe-arming apparatus, for use with a well bore perforator having a receptor detonating explosive and a donor detonating explosive adapted for detonating said receptor explosive, comprising:

a fixed barrier adapted to be disposed between the donor detonating and receptor detonating explosives;

a movable barrier adapted to be disposed between laterally facing portions of said donor detonating and receptor detonating explosives; and a movable barrier actuating means for selectively translating the movable barrier either into engagement with the fixed barrier whereby the donor detonating and receptor detonating explosives are separated by the fixed and movable barriers and are in a predetermined perforator disarming operating position, or into a spaced relationship from the fixed barrier whereby the laterally facing portions of said donor detonating and receptor detonating explosives are in a predetermined perforator-arming operating position.

10. The apparatus of claim 9 wherein said movable barrier actuating means being an elongate member affixed to said movable barrier.

11. The apparatus of claim 9 wherein the ends of the fixed barrier and the movable barrier are formed to provide a lap joint when the fixed barrier and the movable barrier are engaged into the predetermined perforator disarming operating position.

12. The apparatus of claim 11 wherein said movable barrier actuating means is an elongate member affixed to said movable barrier; the ends of the fixed barrier and the movable barrier are slidably engaged with one another by movement of said elongate member; and the ends of the fixed barrier and the movable barrier are formed to provide a lap joint upon being slidably engaged.

13. The apparatus of claim 9 which further includes means for securing the movable barrier in the predetermined perforator arming operating position.

14. The apparatus of claim 13 which further includes guide means for said movable barrier to provide alignment of the movable barrier with respect to the fixed barrier; and the means for securing the movable barrier comprises a flexible detent member disposed on said guide means which is in operative engagement with an end surface of the movable barrier.

* * * * *